United States Patent [19]

Burt et al.

[11] Patent Number: 4,721,205

[45] Date of Patent: Jan. 26, 1988

[54] GUN CONTAINER

[76] Inventors: Brent E. Burt, 3555 Cedar Creek Dr. #107, Shreveport, La. 71119; Clinton E. Burt, Sr., 2816 Meriwether Rd., Shreveport, La. 71108

[21] Appl. No.: 861,144

[22] Filed: May 8, 1986

[51] Int. Cl.[4] ..... B65D 43/12; B65D 85/00

[52] U.S. Cl. ..... 206/317; 206/1.5; 220/315; 220/353; 292/300

[58] Field of Search ..... 70/63, 67, 77, 78, 79, 70/80, 81, 158, 160, 163–173; 206/317, 1.5, 3; 220/346, 329, 315, 324, 326, 300, 353; 292/300, 301, 302, 341.14, DIG. 11

[56] References Cited

U.S. PATENT DOCUMENTS

| | | | |
|---|---|---|---|
| 1,684,412 | 9/1928 | Reiner | 220/300 |
| 2,128,001 | 8/1938 | Kotchavar et al. | 292/302 |
| 2,286,427 | 6/1942 | Levensten | 292/146 |
| 3,329,278 | 7/1967 | Pachmayr | 206/317 |
| 4,048,050 | 9/1977 | Hillman | 206/1.5 |
| 4,061,371 | 12/1977 | Prather et al. | 220/324 |
| 4,155,608 | 5/1979 | Orlewicz | 211/64 |
| 4,412,630 | 11/1983 | Daenen | 220/353 |

FOREIGN PATENT DOCUMENTS

| | | | |
|---|---|---|---|
| 1496934 | 8/1967 | France | 220/353 |
| 0374702 | 6/1932 | United Kingdom | 220/300 |

*Primary Examiner*—Jimmy G. Foster
*Attorney, Agent, or Firm*—John M. Harrison

[57] ABSTRACT

A gun container designed to receive and secure a firearm such as a handgun, which gun container is characterized by a base portion for receiving and supporting the handgun and a cover designed to fit over the base portion, the cover further provided with fixed pins designed to engage U-shaped pin slots provided in the base, in order to removably secure the cover to the base. Spring-loaded pressure pins are also fitted in the base and are designed to engage pin blocks provided in the cover to facilitate a sequence of downward engagement of the fixed pins in the pin slots, lateral traversal of the fixed pins through the pin slots and a final upward movement of the pins in the pin slots, the upward motion of the fixed pins and cover aided by the bias of the spring-loaded pressure pins, to removably secure the cover on the base. Removal of the cover from the base is facilitated by reversing the sequence of fixed pin moves by effecting sequential downward, lateral and upward motion of the cover with respect to the base. In a preferred embodiment, oppositely-disposed retainer pins are also spring-loaded in the base at points near the bottom edges of the cover to further increase the difficulty of removing the cover from the base.

7 Claims, 9 Drawing Figures

GUN CONTAINER

BACKGROUND OF THE INVENTION

1. Field of the Invention

Firearms and handguns in particular, are normally kept in residences and business establishments by collectors and others for sale as well as personal protection. In some cases, the firearms are carelessly stored, exposing them to potential theft and accidental discharge by young children. In other cases, the weapons are kept in locked storaged cabinets or closets, many of which cabinets and closets are fitted with glass doors for display purposes. Numerous accidents occur as a result of the unintentional discharge of firearms and a high percentage of these accidents occur as a result of small children gaining access to firearms and particular handguns, and discharging the guns, either striking themselves or another child.

This invention relates to a weapon safety receptacle and more particularly, to a gun container which is capable of containing and securing handguns, rifles, shotguns and other weapons such as knives and swords, wherein the weapons can be quickly and easily removed from the contained by an adult but are sare from unauthorized use by children.

2. Description of the Prior Art

Many different types of locks, containers and trigger-restraining mechanisms are known in the prior art to secure and prevent firearms from accidentally discharging. Typical of these restraints or locking mechanisms is the popular trigger lock inset, which is inserted between the trigger and the trigger housing of a gun or rifle and must be removed by a key. The lock mechanism prevents the trigger from moving with respect to the trigger housing when the gun is handled. Other weapon security devices have taken the form of enclosures or trays for supporting and containing handguns and other weapons, with various types of restraining mechanisms and locks provided for securing firearm inside the containers or trays. U.S. Pat. No. 3,329,278, dated July 4, 1967, to Frank A. Pachmayr, entitled "Gun Holding Tray" is typical of this latter class of handgun containers. The "Gun Holding Tray" disclosed in this patent employs a succession of upstanding, relatively movable members which are designed to receive and clamp gun barrels between them. The clamps immobilize the handguns inside the tray and the tray is provided with a closure or lid in conventional fashion. A "Firearm Safety Box" is disclosed in U.S. Pat. No. 3,307,755, to M. E. Lentz. The "Firearm Safety Box" includes a box structure with a template designed to receive the upper part of a selected firearm such as a handgun, and a safety rod which is rotatably attached to the template and is adapted to fit into the barrel of the firearm. The safety rod is further designed to extend into the chamber and a safety finger is fitted into the clip opening of the firearm. The container is provided with a cover for closing and locking the firearm therein. U.S. Pat. No. 3,369,721, also to M. E. Lentz, dated Feb. 20, 1968, and also entitled "Firearm Safety Box," represents a variation of the firearm safety box noted in U.S. Pat. No. 3,307,755. The safety container detailed in U.S. Pat. No. 3,369,721 includes a generally box-like structure having a safety rod adapted to fit into the chamber of a selected firearm, with the opposite end of the rod adapted to act as a key to close a lock mechanism. A safety finger is adapted to fit into the clip opening of the firearm and the box is closeable only when the safety rod and safety finger are positioned in the firearm. U.S. Pat. No. 4,119,199, dated Oct. 10, 1978, to Johnny B. Whitaker, Jr., discloses a "Weapon Safety Receptacle". The "Weapon Safety Receptacle" detailed by this patent embodies a housing section having an upstanding rear wall connected at its lower end to a forwardly extending wall, which is in turn connected to an upstanding front wall that terminates below the upper end of the rear wall, to define an access opening between the upper edges of the front and rear walls. A cover section is characterized by a top wall connected to a depending rear wall, which engages a recess in the upper rear portion of the rear wall of the housing section. A depending front wall of the cover section extends alongside the outer surface and terminates below the upper edge of the front wall of the housing section. A resilient member connects the cover section to the housing section and urges the cover section toward and into engagement with the housing section. A "Gun Cabinet" is disclosed in U.S. Pat. no. 4,155,608, dated May 22, 1979, to Mark L. Orlewicz. The patent details a cabinet for secure storage of a gun, which cabinet is adapted to be mounted in the recess of a wall wherein an outer door of the cabinet simulates a decorative wall article. Directly behind the outer door is a lockable, transparent inner door, whereby the user of the cabinet may conveniently inspect and display the contents of the cabinet. An adjustable fixture located inside the cabinet retains the gun in desired position and accomodates a range of styles and sizes of small guns. Quick access to the gun or guns is facilitated in the retention fixture for quick release of the gun and the interior of the cabinet is illuminated when the cabinet door is opened.

One of the problems which is apparent from a consideration of existing locking and security devices for guns and particularly handguns, is complexity. Furthermore, this complexity is dangerous under circumstances where the handgun must be regularly accessible and usable in emergency situations. Many of the more sophisticated security devices require a key to unlock the firearm or the cabinet containing the firearm or firearms and the key must therefore remain accessible to the owner at all times. Furthermore, the opposite extreme of having a handgun readily available for any emergency presents an obvious danger to small children, as well as various opportunities for theft of the weapon or weapons.

Accordingly, it is an object of this invention to provide a new and improved gun container for weapons and particularly handguns, which gun container is characterized by a box-like structure having a base and a removable cover fitted to the base, wherein the cover must be manipulated in a preselected sequence with respect to the base in order to remove the cover from the base.

Another object of this invention is to provide a new and improved gun container for firearms and particularly handguns, which gun container is shaped to contain substantially any handgun or weapon and includes a base portion and a cover portion, wherein the base portion is provided with a pair of oppositely- disposed, generally U-shaped grooves or tracks and the cover is fitted with cooperating fixed pins for traversing the grooves or tracks in a specified sequence, in order to lock a handgun or weapon inside the container and remove the handgun or weapon from the container by following the preselected sequence.

Yet another object of this invention is to provide a handgun container for, enclosing handguns, which container is characterized by a shaped base and cover which base is provided with spring-loaded pressure pins and a pair of shaped grooves provided in opposite sides thereof and the cover is fitted with fixed pins projecting inwardly of the cover and designed to engage the grooves when the cover engages the spring-loaded pins, wherein the fixed pins are caused to traverse the grooves in a preselected sequence according to the shape of the grooves when the cover is placed on the base, and retrace the grooves in a reverse of that sequence when the cover is removed from the base, in order to prevent children from removing the handgun from the gun container.

Still another object of the invention is to provide a handgun security container which includes a base portion for receiving the handgun, which base portion is provided with two pairs of generally U-shaped grooves and a pair of oppositely-disposed, spring-loaded retainer pins and further including a cover portion having four inwardly projecting, fixed pins adapted to engage and traverse the grooves to attach the cover to the base and remove the cover from the base in a reverse of the closing sequence, when the oppositely-disposed retainer pins are depressed to allow clearance between the cover and the base.

SUMMARY OF THE INVENTION

These and other objects of the invention are provided in a handgun container which is characterized by a base for containing a handgun, four generally U-shaped grooves provides in the base along with four spring-loaded pressure pins, and a cover designed to fit over the base to enclose the handgun, which cover is fitted with facing, inwardly-projecting fixed pins for engaging the grooves in sequence and locking the cover on the base, wherein the cover can be removed from the base only be retracing the closing sequence. In a preferred embodiment a pair of oppositely-disposed, spring-loaded retainer pins are provided in the base to prevent activation of the removal sequence prior to manipulation of the retainer pins.

BRIEF DESCRIPTION OF THE DRAWING

The invention will be better understood by reference to the accompanying drawing, wherein.

DESCRIPTION OF THE PREFERRED EMBODIMENTS

Figure 1:
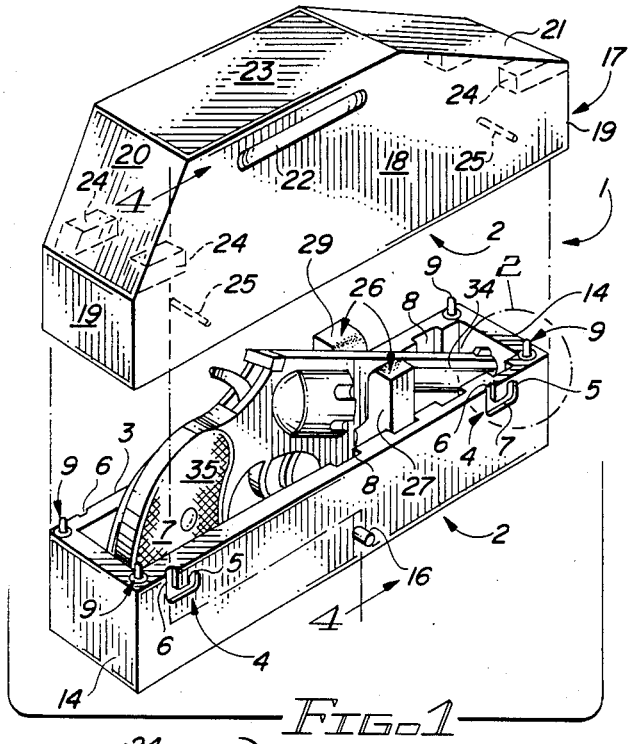
FIG. 1 is a perspective, exploded view of a preferred embodiment of the gun container of this invention.
Figure 2:
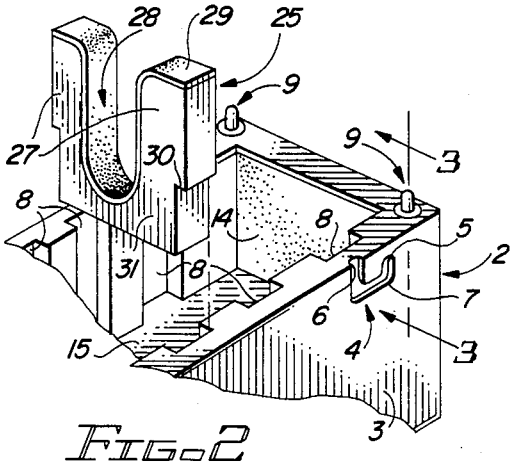
FIG. 2 is an enlarged view of a portion of the base of the gun container illustrated in FIG. 1, more particularly illustrating a support yoke for a handgun.
Figure 5A:
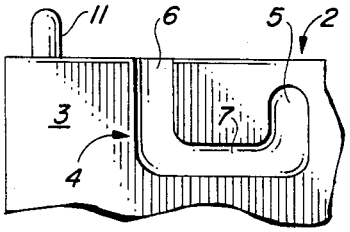
FIG. 5A is a plan view of one side of the base, illustrating a preferred configuration for the U-shape slot therein.

Referring initially to FIGS. 1, 2 and 5A of the drawing in a preferred embodiment, the gun container of this invention is generally illustrated by reference numeral 1. The gun container 1 is characterized by a base 2, defined by parallel base ends 14 and parallel base sides 3, each of the base sides 3 provided with a pair of spaced U-shaped slots 4, oriented in oppositely-disposed relationship, as illustrated. A bottom 15 spans the base ends 14 and the base sides 3. Each U-shaped slot 4 is further characterized by a short slot tip 5 and a slot entrance 6, which are disposed in substantially parallel relationship and are connected at corresponding ends by a slot run 7, as more particularly illustrated in FIG. 5A. Multiple, parallel yoke slots 8 are disposed in perpendicular relationship in the inside surfaces of the base sides 3 in order to accomodate a yoke 26, provided with parallel yoke posts 27 and a curved yoke slot 28. The yoke 26 is designed to engage selected ones of the yoke slots 8 and the yoke base 31 is seated in a selected pair of the yoke slots 8 when the yoke shoulders 30 engage the top surfaces of each of the base sides 3, as illustrated in FIG. 2. In a preferred embodiment of the invention a slot liner 29 is provided in the curved yoke slot 28 and terminates on the yoke posts 27, in order to accomodate the barrel 34 of a handgun 33 which is disposed in the base 2, as illustrated in FIG. 1. The base 2 is sufficiently long to receive both the handle 35 and the barrel 34 of the handgun 33 and the yoke 29 serves to stabilize the handgun 33 in the base 2.

Figure 3:
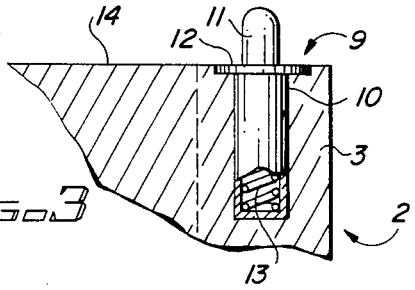
FIG. 3 is a sectional view taken along line 3—3 in FIG. 2, more particularly illustrating a preferred design for the spring-loaded pressure pins.

In another preferred embodiment of the invention and referring again to FIGS. 1–3 of the drawing, four spring-loaded pressure pins 9, which are particularly detailed in FIG. 3, are positioned in perpendicular relationship in the top surfaces of the base sides 3 at the points of juncture with the base ends 14, respectively. The spring-loaded pressure pins 9 are each characterized by an outer pin cylinder 10, which receives an inner pin shaft 11 in reciprocating relationship, with the cylinder flange 12 designed to stabilize the spring-loaded pins 9 in the base sides 3. A coil spring 13 is provided in the interior of each pin cylinder 10 and is engaged by a companion pin shaft 11, in order to bias the pin shaft 11 inside the pin cylinder 10 when the cover 17 is fitted on the base 2, as hereinafter described.

In a most preferred embodiment of the invention, a pair of retainer pins 16 are also provided in spring-loaded relationship in the base sides 3 and extend transversely from the base sides 3 outwardly in oppositely-disposed relationship, as illustrated in FIG. 1. As further illustrated in FIG. 1 the cover 17 is designed with parallel cover sides 18, parallel cover ends 19 spacing the cover sides 18 and with a rear cover bevel 20 extending upwardly from the rear one of the cover ends 19. A front cover bevel 21 projects upwardly from the opposite cover end 19 and a cover top 23 joins the front cover bevel 21 and the rear cover bevel 20, as illustrated. In another preferred embodiment of the invention, a groove 22 is provided in both of the cover sides 18 near the cover top 23, to aid in gripping the cover 17, as hereinafter described. As further illustrated in FIG. 1, four pin blocks 24 are located in each of the four corners of the cover 17 adjacent the front cover bevel 21 and the rear cover bevel 20 and are oriented in alignment with the spring-loaded pressure pins 9 when the cover 17 is positioned over the base 2. Two pairs of fixed pins 25 also project toward each other in spaced, facing relationship from the inside surfaces of the covre sides 18, as ilustrated in FIGS. 1 and 4A–4C.

Figure 4A:
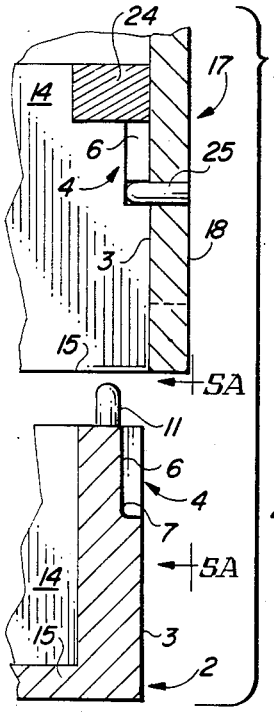
FIG. 4A is a sectional view taken along line 4—4 in FIG. 1, more particularly illustrating a first relative position of the cover with respect to the base.
Figure 4B:
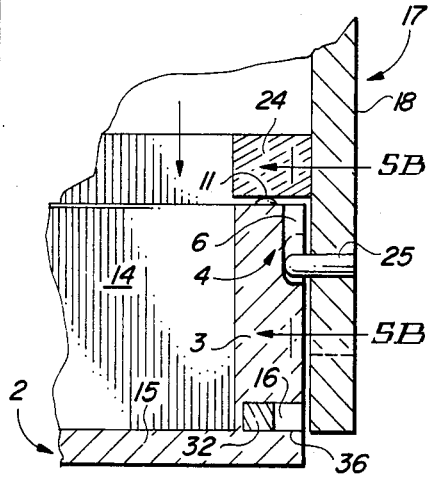
FIG. 4B is a sectional view taken along line 4—4 in FIG. 1, more particularly illustrating a second relative position of the cover with respect to the base.
Figure 4C:
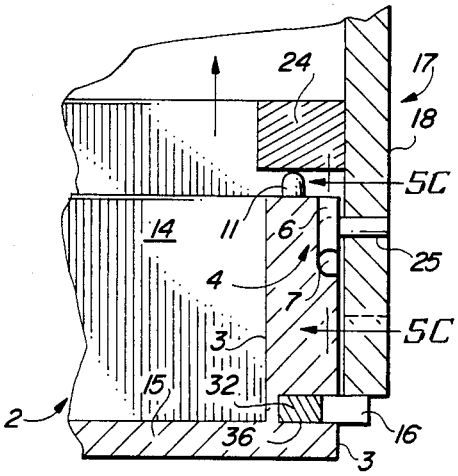
FIG. 4C is a sectional view taken along line 4—4 in FIG. 1, more particularly illustrating third and final relative position of the cover with respect to the base, wherein the cover is secured to the base.

Referring now to FIGS. 4B and 4C of the drawings in another preferred embodiment of the invention, a retainer pin seat 36 is provided in both of the base sides 3 near the bottom 15 of the base 2 and a pair of retainer pins 16 are seated in the retainer pin seats 36, respectively, as illustrated. In a most preferred embodiment the retainer pins 16 are biased in the retainer pin seats 36 by means of retainer pin springs 32, in order to urge the retainer pins 16 into a normally extended position with respect to the base sides 3, as illustrated in FIG. 4C. However, when the cover 17 is manipulated in either a closing or opening sequence and the fixed pins 25 are traversing the slot runs 7 of the U-shaped slots 4, respectively, the retainer pins 16 are recessed inside the retainer pin seats 36 against the bias of the retainer pin springs 32 by the cover sides 18, as illustrated in FIG. 4B.

Figure 5B:
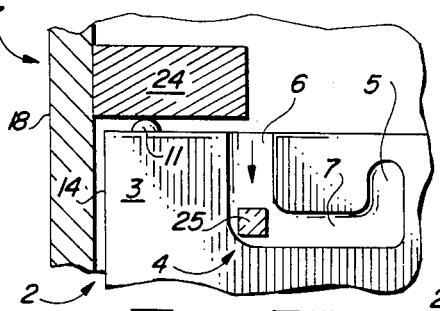
FIG. 5B is a plan view of that side of the base illustrated in FIG. 5A, more particularly illustrating an initial relative position of a fixed pin engaging the U-shaped slot.
Figure 5C:
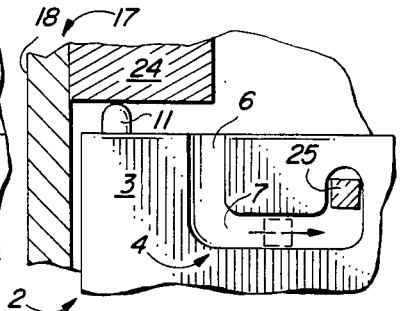
FIG. 5C is a plan view of that side of the base illustrated in FIGS. 5A and 5B, more particularly illustrating a final relative position of the fixed pin in the U-shaped slot, wherein the cover is secured to the base.

Referring now to FIGS. 1, 4A–4C and 5A–5C, when it is desired to engage the cover 17 with the base 2 and enclose the handgun 33 inside the cover 17, the cover 17 is initially placed above the base 2 as illustrated in FIG. 1. The cover 17 is then lowered over the base 2 until the fixed pins 25 enter the slot entrances 6 of the U-shaped slots 4, respectively, and the bottom edges of the cover sides 18 engage the retainer pins 16 projecting from the base sides 3, as illustrated in FIGS. 1 and 4C. The retainer pins 16 are then manually depressed against the bias of the retainer pin springs 32 by the finger and the thumb of one hand, to allow the cover sides 18 of the cover 17 to extend below each of the retainer pin seats 36, as illustrated in FIG. 4B. This depression of the retainer pins 16 also serves to facilitate entry of the projecting ends of the cover pins 25 further into the respective slot entrances 6. As the cover pins 25 traverse the respective slot entrances 6, the pin blocks 24 engage the pin shafts 11 in the spring-loaded pressure pins 9, respectively. The cover 17 is then forced further downwardly against the pin shafts 11 and the bias of the springs 13 located inside the pin cylinders 10, until the pin shafts 11 are depressed substantially inside the pin cylinders 10 and the cover pins 25 project into the slot run 7 of the U-shaped slot 4, as illustrated in FIGS. 4B and 5B. Pressure on the cover 17 is then adjusted forwardly in the direction of the arrow as illustrated in FIG. 5C, to urge the cover pins 25 along the slot run 7 in each of the U-shaped slots 4 respectively. When the cover pins 25 reach the end of each slot run 7, respectively, and enter the base of the slot tips 5, pressure is then released from the cover 17 and the pin shafts 11 in the spring-loaded pressure pins 9 urge the cover 17 upwardly until the cover pins 25 are seated in the top segment of the slot tips 5, as illustrated in FIGS. 4C and 5C of the drawing. This action causes the retainer pins 16 to extend outwardly of the retainer pin seats 36 responsive to the bias of the retainer pin springs 32, as illustrated in FIG. 4C, to block further downward movement of the cover 17 with respect to the base 2. When the cover 17 is in this closed position with respect to the base 2, it cannot be removed by a child without retracing the engaging sequence outlined above by causing the cover pins 25 to first move downwardly in the slot tip 5, laterally through the slot run 7 and then upwardly through the slot entrance 6, to remove the cover 17 from the base 2. Furthermore, when it is desired to remove the cover 17 from the base 2 in a gun container 1 which is fitted with retainer pins 16, the retainer pins 16 are initially depressed against the bias of the retainer pin springs 32 to allow the cover sides 18 to clear the retainer pins 16 and move downwardly with respect to the base 2. The cover 17 is then pressed downwardly to facilitate movement of the cover pins 25 downwardly in the slot tips 5 and rearwardly in a direction opposite to the arrow illustrated in FIG. 5C, to cause the cover pins 25 to traverse the slot run 7 in the U-shaped slots 4. When the cover pins 25 reach the slot entrances 6 in the U-shaped slots 4, pressure is released from the cover 17, thus allowing the biased pin shafts 11 to force the cover 17 upwardly with respect to the base 2 and facilitate traversal of the cover pins 25 through the slot entrance 6 and removal of the cover 17 from the base 2.

It will be appreciated by those skilled in the art that the gun container of this invention serves to securely and yet removably contain a handgun or other weapon with minimal risk of discharging the handgun due to tampering by a child. It has been found by experiment that children normally do not have the manual dexterity nor the understanding to effect the necessary movements of the cover 17 with respect to the base 2 in order to remove the cover 17 from the base 2 and retrieve the handgun 33 from within the gun container 1. However, it will be readily apparent that an adult can quickly and easily master the sequence of movements necessary to first enclose the handgun 33 within the gun container 1 and then remove the handgun 33 from the gun container 1 in an emergency.

It will be further appreciated by those skilled in the art that the relative shape of the base 2 and the cover 17 in the gun container 1 can be changed or altered as desired, in order to accomodate a weapon of substantially any size and bulk. Accordingly, knives, swords, rifles, shotguns and other weapons of various shape can be enclosed within a container of appropriate size and shape, so long as the base 2 and the cover 17 are designed in accordance with the teachings of this invention. Furthermore, it will be appreciated that the base 2 and the cover 17 can be manufactured of a variety of materials, including metal, wood, fiberglass, and plastics including injection-molded plastics, and other materials well known to those skilled in the art. Furthermore, the gun container 1 can be shaped to resemble a work of art or artifact instead of an obvious weapon enclosure also according to the knowledge of those skilled in the art, in order to avoid theft.

Referring again to the drawings it will be further appreciated that the gun container 1 can be designed with or without the retainer pins 16, depending upon the individual owners' preference. For example, as children grow older they become more adept at solving puzzles and as their manual dexterity increases, use of the retainer pins 16 provides an added security advantage, in that the retainer pins 16 must be depressed before the cover 17 can be manipulated with respect to the base 2, in order to remove the cover 17 from the base 2. Accordingly, the retainer pins 16 supply an added degree of difficulty in removing the cover 17 from the base 2 for older children.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A gun container for securing a firearm comprising:

(a) a hollow base member shaped to receive the firearm;

(b) a plurality of generally U-shaped grooves provided in the sides of said base member adapted to respectively receive rigid pins for movement downwardly, forwardly and upwardly therein;

(c) a cover adapted to fit over said base member;

(d) a plurality of rigid pins projecting from the sides of said cover inwardly of said cover toward said base, said rigid pins adapted to engage and traverse said grooves, respectively, when said cover is manipulated downwardly, forwardly and upwardly in sequence with respect to said base member;

(e) a plurality of pressure pins provided in spaced relationship in said base member and adapted for exerting pressure on said cover when said cover is fitted on said base member; and (f) a plurality of pin blocks provided in said cover in alignment with said pressure pins, adapted for engaging said pressure pins when said cover is fitted on said base member.

2. The weapon container of claim 1 wherein said firearm is a handgun and further comprising a yoke carried by said base adapted for supporting said handgun in said base.

3. The weapon container of claim 1 further comprising a pair of spring-loaded retainer pins provided in oppositely-disposed, transverse relationship in said base and being adapted for engaging the bottom edges of said cover and preventing said rigid pins from traversing said grooves prior to depressing said retainer pins when said cover is fitted on said base.

4. A gun container for securing a handgun comprising:

(a) a generally rectangular-shaped, hollow base;

(b) four spring-loaded pressure pins provided at the corners of said base, said pressure pins projecting vertically above the plane of said base;

(c) four generally U-shaped grooves provided in the sides of said base adapted to respectively receive rigid pins for movement downwardly, forwardly and upwardly therein, said grooves arranged in spaced, oppositely-disposed pairs;

(d) a generally rectangular-shaped cover having a hollow interior and adapted to fit over said base;

(e) four pin blocks provided in said cover in alignment with said pressure pins for engaging said pressure pins when said cover is fitted on said base; and (f) four rigid pins projecting horizontally from said cover into said hollow interior, said rigid pins adapted to engage and traverse said grooves and secure said cover on said base when said cover is moved downwardly, forwardly and upwardly against the bias of said pressure pins.

5. The gun container of claim 4 further comprising a plurality of slots provided in said base and a yoke engaging selected ones of said slots, said yoke adapted to receive and support the handgun.

6. The gun container of claim 4 further comprising a pair of spring-loaded retainer pins provided in oppositely-disposed, transverse relationship in said base and being adapted for engaging the bottom edges of said cover and preventing said rigid pins from traversing said groove prior to depressing said retainer pins when said cover is fitted on said base.

7. The gun container of claim 4 further comprising:

(a) a pair of spring-loaded retainer pins provided in oppositely-disposed, transverse relationship in said base and being adapted for engaging the bottom edges of said cover and preventing said rigid pins from traversing said groove prior to depressing said retainer pins when said cover is fitted on said base; and (b) a plurality of slots provided in said base and a yoke engaging selected ones of said slots, said yoke adapted to receive and support the handgun.

* * * * *